United States Patent [19]

Savage

[11] 4,288,156

[45] Sep. 8, 1981

[54] CARRIER FOR SHEET OF PHOTOGRAPHIC PAPER

[76] Inventor: David H. Savage, 4806 Castlewood Dr., Lilburn, Ga. 30247

[21] Appl. No.: 118,567

[22] Filed: Feb. 4, 1980

[51] Int. Cl.[3] ..... G03D 13/12

[52] U.S. Cl. ..... 354/312; 354/344

[58] Field of Search ..... 354/331, 333, 335, 337, 354/338, 340, 344, 312, 342, 343, 345, 346, 347, 314, 315; 206/455

[56] References Cited

U.S. PATENT DOCUMENTS

| | | | |
|---|---|---|---|
| 389,300 | 9/1888 | Hamel | 10/47 |
| 638,916 | 12/1899 | Doyle | 354/340 |
| 689,300 | 12/1901 | Gilbert | 354/340 |
| 987,821 | 3/1911 | Parkmire | 354/337 |
| 1,695,644 | 12/1928 | Faber et al. | 354/344 |
| 1,845,800 | 2/1932 | Kreuder | 354/344 |
| 2,436,882 | 3/1948 | Edelhart | 354/344 |
| 3,054,341 | 9/1962 | Wolber | 354/344 |
| 3,083,427 | 4/1963 | Grenon | 354/345 |
| 3,292,520 | 12/1966 | Tucker | 354/344 |
| 3,316,827 | 5/1967 | Hill | 354/343 |
| 4,168,899 | 9/1979 | Klass | 354/344 |

FOREIGN PATENT DOCUMENTS

| | | | |
|---|---|---|---|
| 636200 | 2/1962 | Canada | 354/344 |
| 46590 | 3/1909 | Sweden | 354/344 |

*Primary Examiner*—L. T. Hix
*Assistant Examiner*—Alan Mathews
*Attorney, Agent, or Firm*—Jones, Thomas & Askew

[57] ABSTRACT

A carrier for a sheet of photographic paper or the like. The carrier including a plate smooth on one side for receiving a piece of wet paper which will adhere thereto through surface tension of the liquid, a lip at the lower edge of the plate to secure the leading edge of the paper as the carrier is immersed into a liquid bath, guides on each side of the plate both to align a sheet of paper and to space a plurality of carriers appropriately when stacked, and an irregular surface on the back of the plate to prevent paper from adhering thereto when wet.

8 Claims, 10 Drawing Figures

CARRIER FOR SHEET OF PHOTOGRAPHIC PAPER

TECHNICAL FIELD

This invention relates generally to carriers for single sheets of material, and is more particularly concerned with a carrier for a sheet of sensitized paper and other sheet material during processing.

BACKGROUND OF THE INVENTION

In processing sensitized sheet material, such as photographic film, print paper and the like, it is necessary to immerse the sheet into several different liquid baths. During the processing of the sheet, however, it is important not to mar the treated surface or the final result will not be of the desired quality. In the case of conventional photographs, a fingerprint, for example, on the coated, or emulsion, side of the paper or film can yield the fingerprint image on the finally processed paper.

In the past, efforts to prevent damage to the emulsion on photographic films and papers have taken the form of tongs with plastic or rubber tips for handling the paper. Tongs, however, can be used for only one sheet at a time so that processing a large volume of prints using tongs would be very time consuming. For processing large quantities of material there have been frames for holding a piece of film or paper whereby a piece of coated material is held by its edges, allowing the liquid bath to contact the surfaces of the material. The prior art frames normally comprise a plurality of channels into which a sheet of material slides so that the sheet is held along three edges. Such frames tend to be difficult to use because one must be very careful in placing the sheet into the frame to prevent folding or creasing of the edges. Once in such a frame, the sheet can bow sufficiently that its edges may come out of the channels, resulting in numerous problems. Currently, a drum process is frequently used for photographic materials. While a drum processor provides a number of advantages, it is very limited in the volume of paper it can handle, and it is subject to contamination. Thus, it becomes difficult to process a large number of sheets in a drum processor because the drum must be very carefully cleansed for each few sheets that are processed.

U.S. Pat. Nos. 638,916 and 389,300; Swiss Patentschrift No. 46,590 and Canadian Pat. No. 636,200 (all incorporated herein by reference) relate to photographic film or paper holders but are not believed to overcome the forementioned disadvantages.

SUMMARY OF THE INVENTION

The present invention overcomes the above-mentioned and other difficulties with the prior art carriers by providing a carrier comprising a plate having a smooth surface for receiving a sheet of material, and a lip along the bottom edge of the plate. Guides are provided along opposite edges of the plate which guides also serve to space a plurality of carriers apart. Additionally, the backside of the plate can be formed with dimples, grooves or other similar structures for providing an uneven or irregular surface.

The present invention utilizes the smooth surface of the plate to adhere the sheet of material, the sheet of material having preferably been wetted prior to insertion into the carrier. The lip protects the lower, or leading, edge of the sheet as the carrier is immersed into a liquid, preventing the force of the liquid from separating the sheet from the plate. The back surface of the plate is uneven so that the sheet of material in the carrier does not adhere to the back of an adjacent stacked plate when both surfaces are wet.

The present invention also includes a processing tank for simultaneously processing a plurality of sheets of material. The processing tank includes a sleeve for receiving a plurality of the above-described carriers and a tank for receiving the sleeve. An opening in the bottom of the sleeve permits liquid in the tank to communicate with the paper in the carrier when the sleeve is received in the tank.

Accordingly, it is an object of the present invention to provide an improved carrier for sheet material.

Another object of the present invention is to provide a carrier for sheet material which can be stacked with other similar carriers.

A further object of the present invention is to provide a carrier for sheet material which keeps the sheet material flat when immersed in a liquid bath.

Yet another object of the present invention is to provide an improved processing tank for simultaneous processing of a plurality sheets of materials.

These and other objects, features and advantages of the present invention will become apparent after a review of the following detailed description of the preferred embodiment and the appended drawing and claims.

DETAILED DESCRIPTION OF THE PREFERRED EMBODIMENT

Figure 1:
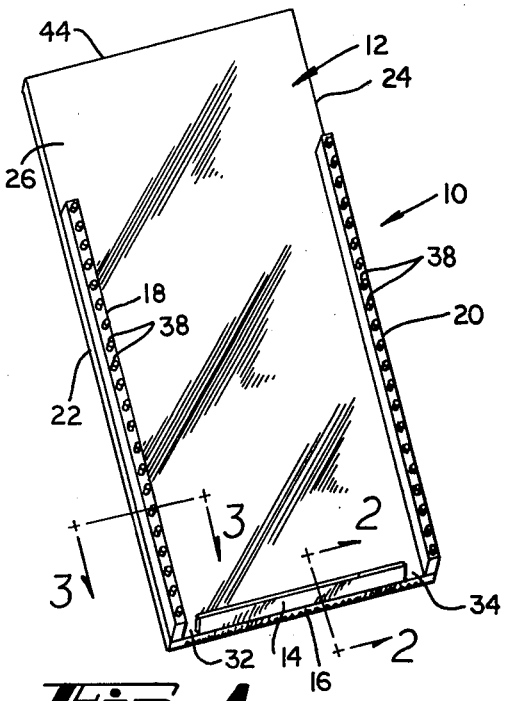
FIG. 1 is a perspective view of a disclosed embodiment of the carrier of the present invention.

Referring now to the drawing in which like numbers indicate like elements throughout the several views, it will be seen that there is a carrier 10 for photographic paper which includes a generally rectangular plate 12 having a lip 14 along the lower edge 16 of the plate 12. Guides 18,20 are disposed along the side edges 22, 24 respectively of the plate 12. The surface 26 of the plate 12 is smooth for receiving a sheet of paper as will be discussed more fully hereinbelow. The rear surface 28

Figure 2:
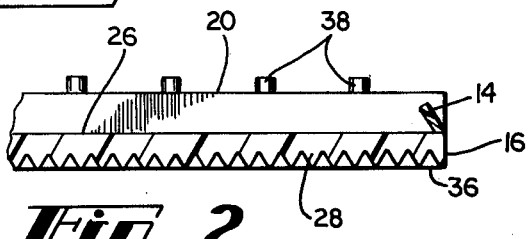
FIG. 2 is an enlarged cross-sectional view taken along the line 2—2 of the carrier shown in FIG. 1.
Figure 3:
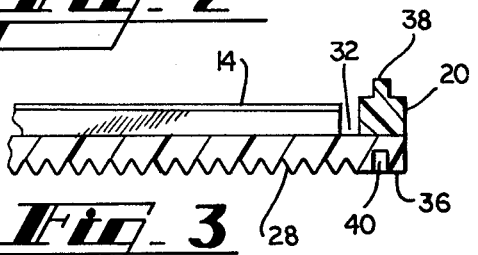
FIG. 3 is an enlarged cross-sectional view taken along the line 3—3 of the carrier shown in FIG. 1.

(as best shown in FIGS. 2 and 3) is irregular or uneven to prevent the sticking of a piece of photographic paper thereto.

It should be understood by those skilled in the art that when a piece of paper is wet, the paper will adhere to a smooth surface. The smooth surface and the paper should be thoroughly wetted for good adhesion of the paper to the surface. The adhesion is due to the fact that the liquid adheres to both the surfaces, i.e., the smooth surface and the paper, and the surface tension of the liquid maintains cohesiveness of the liquid extending between the paper and the smooth surface of the plate. It will further be understood that, though a piece of paper will be relatively firmly adhered to the smooth surface 26 of the plate 12, care must be taken to assure complete adhesion of the paper, and care must be taken not to exert forces that would tend to remove the paper from the smooth surface since only surface tension of a liquid holds the paper to the smooth surface.

With the foregoing in mind, and with particular reference to FIGS. 2 and 3 it will be seen that the irregular surface 28 of the plate 12 appears corrugated in both figures which shows that the grooves of the corrugations extend in both directions, generally perpendicular to each other. The result is therefore the surface 28 that includes a plurality of pyramid-like or dimpled shapes arranged in parallel rows. It will be understood that the surface is desirable in that a piece of paper engaged with the irregular surface 28 will engage only a plurality of points thereby allowing a sufficient quantity of air to be between the sheet of paper or the like and the irregular surface so that adhesion of the paper to the irregular surface, even in the presence of a considerable quantity of liquid, is unlikely. Although the surface 28 has been described as having a corrugated surface, it should be understood that other irregular or non-planar surfaces which do not stick to wet sheets of material are also useful.

Referring to FIG. 2, it will be seen that the lip 14 is formed by fixing a generally rectilinear flange member to the surface 26 of the plate 12 along the lower edge 16. The flange member is fixed to the plate 12 with the longitudinal axis of the member extending transversely of the plate and generally parallel to the edge 16 so that a flat side of the member faces the area of the surface 26 that is to receive a piece of paper and is inclined from the surface at an acute angle; preferably approximately 45°. While numerous shapes of lips 14 can be provided at the edge 16, it will be seen that the rectangular shape is admirably suited in that a relatively thin piece of paper can extend between the inclined surface of the flange member and the surface 26 of the plate 12, and the edge of the thin paper will be adequately held by the lip 14. Furthermore, a relatively thick piece of paper can similarly be urged against the lip 14, and the inclined surface of the flange member will again urge the thicker piece of paper against the surface 26 of the plate 12. The inclined surface of the flange member will act as a lip, holding a piece of paper against the surface 26 of the plate 12, until the piece of paper is so thick as to exceed the height of the inclined surface above the surface 26 of the plate 12. In view of this, a rectangular member can be selected for the lip 14 to accept a range of paper thicknesses to be used with the carrier 10.

Figure 6:
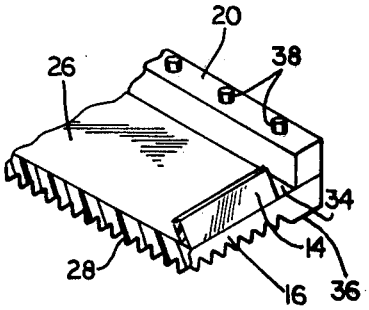
FIG. 6 is a fragmentary perspective view showing an alternate disclosed embodiment of the lip for the carrier shown in FIG. 1.

Since the object of the lip 14 is to hold a piece of paper against the surface 26, it will be readily understood that a shape other than the rectangular flange member illustrated can be used. A simple form of lip that will operate satisfactorily is a cylindrical member. Also, a plurality of tabs having the shape of the lip 30 (FIG. 6) may be used rather than the full rectangular member 14, so that liquid drainage would be facilitated. Other forms for the lip will also suggest themselves to those skilled in the art.

Figure 4:
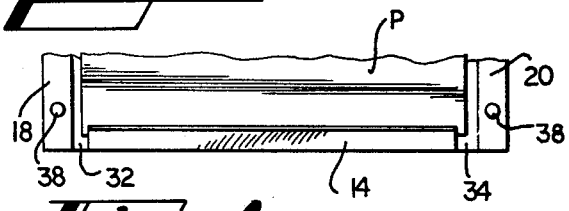
FIG. 4 is a partial front elevation view of the carrier shown in FIG. 1.

Referring to FIGS. 3 and 4, it will be seen that the lip 14 extends substantially to the guides 18, 20; however, a small space 32 remains between the end of the lip 14 and the guide 18, and a space 34 is similarly provided between the lip and the guide 20. The spaces 32, 34 are provided to allow liquid to be drained from the vicinity of the lip 14, as will be discussed more fully hereinbelow. As best seen in FIGS. 2 and 3, the guides 18, 20 extend above the lip 14.

It should be noted that the peripheral edges 36 of the surface 28 of the plate 12 is not corrugated, but rather, is smooth. These peripheral edges 36 correspond exactly in dimensions and location to the guides 18, 20 located on the opposite side of the plate 12. Formed on the top surface of the guides 18, 20 are a plurality of cylindrical projections 38. Formed in the peripheral edges 36 are a plurality of holes 40 sized and shaped to accomodate the projections 38.

Figure 5:
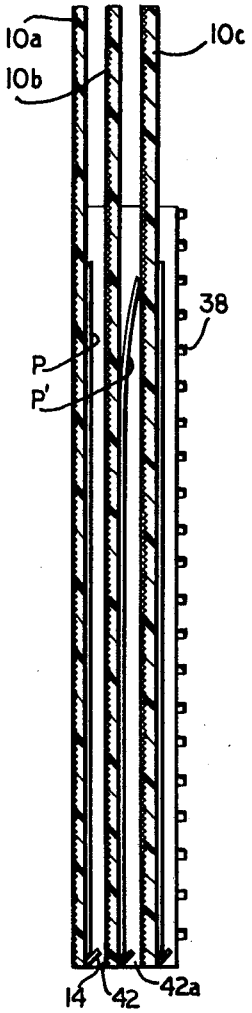
FIG. 5 is a longitudinal cross-sectional view showing a plurality of carriers such as the carrier shown in FIG. 1, the carriers being stacked for simultaneous processing.

In FIG. 5 it will be seen that a plurality of carriers **10*a*, 10*b*, 10*c* are stacked together, the peripheral edges 36 of the rear surface 28 of the carrier 10*b* rest on the guides 18, 20 of the carrier 10*a* so that the projections 38 are received in the holes 40. Similarly, the peripheral edges 36 of the carrier 10*c* rest on the guides 18, 20 of the carrier 10*b*, and the projections 38 and holes 40 respectively thereof are similarly engaged. It will be appreciated by those skilled in the art that when the projections 38 are received in the holes 40, the carriers 10*a*, 10*b*, 10*c* are held firmly together. It will also be appreciated that the carriers 10*a*, 10*b*, 10*c* are easily separable by disengaging the projections 38 from the holes 40. This feature allows a plurality of carriers 10 to be quickly and easily assembled and disassembled. It is contemplated that a plurality of the carriers 10 will be thusly stacked when the carriers are in use, and there will be a piece of paper P adhered to the surface 26** of each of the carriers so that all of the pieces of paper can be processed through the same liquid baths simultaneously.

With reference to FIG. 5, it will be seen that there is a space 42 between the lip 14 of the carrier **10*a* and the plate 12 of the carrier 10*b* so that liquid can pass through the space 42 and engage the surface of the paper P that is adhered to the surface 26 of the plate 12 of carrier 10*a*. A similar space 42*a* is between the lip 14 of the carrier 10*b* and the plate 12 of the carrier 10*c*. Thus, when the group of carriers 10*a*–10*c* is immersed into a liquid bath, the liquid will pass through the spaces 42, 42*a* (and other similar spaces in the event more carriers are placed together) and the liquid bath will contact the paper P on each of the carriers. It is also contemplated that the carriers 10*a*–10*c* will be immersed into a liquid sufficiently that the liquid will cover the guides 18, 20; and, since there is no obstruction at the upper ends of the guides, liquid will be able to circulate freely from the lower edge of the carrier 10** to the upper edge of the guides. This construction allows the liquid to circulate in the event the liquid is physically circulated by a pump or the like; or, the arrangement also allows the circulation that is normal in a chemical reaction wherein ions tend to diffuse uniformly throughout a liquid solution.

From the foregoing, it should now be understood by those skilled in the art that the carrier 10 of the present invention is very simple in construction, yet very efficient in operation. When a piece of paper is to be placed on a carrier 10, the paper can be wetted and/or the surface 26 of the carrier can be wetted to improve initial adhesion of the paper to the surface 26. However, initially wetting the paper or carrier is not necessary as immersion of the carrier and paper into a liquid bath will result in the wetting of both surfaces. The paper is then placed on the surface 26 of the carrier with the lowermost edge of the paper firmly engaging the lip 14 so that the inclined surface of the flange member will tend to urge the edge of the paper against the surface 26. It will be appreciated that as the paper is being placed on the surface 26 of the plate 12, the guides 18, 20 help to align the paper on the surface. The guides 18, 20 also serve to space a plurality of carriers when appropriately stacked. One can then immerse the carrier 10 into a tank of liquid while holding on to the extreme upper end 44 of the plate 12. It will be understood that a piece of paper will adequately adhere to the surface 26 of the plate 12 without danger of being inadvertently removed; however, when the carrier 10 is forcefully immersed into a liquid bath, the fact that the liquid could impinge on an edge of a sheet of paper could cause the paper to release from the surface 26. It is for this reason that the lip 14 is provided, the lip 14 being positioned to guard the leading edge of the paper as the carrier 10 is immersed into a liquid.

Additionally, when a plurality of carriers is stacked together as shown in FIG. 5, the provision of the spaces **42, 42*a* provides a slot across the width of the carrier so that, as liquid enters the slot, the liquid flows uniformly across the paper, flowing from bottom to top of the paper, and the liquid proceeds with laminar flow for a uniform wetting of the surface of the paper by the liquid bath. It will of course be understood by those skilled in the art that uniform engagement of the paper by the processing liquid is important in photographic work to prevent streaking, blotting and the like. Also, it will be seen in FIG. 5 that a piece of paper P′ is illustrated with the upper end of the paper bowed and engaging the rear surface 28 of the carrier 10*c*. As has been previously discussed, there is no danger that the paper P′ will adhere to the surface 28 because of the irregular nature of the surface 28. However, it should also be understood that, as the liquid enters the slot 42*a* and flows uniformly upwardly, the force of the bath will tend to urge the paper P′ down against the surface 26 of the carrier 10*b*. Since both the surface 26 and the paper P′ will be wet, the paper P′ will tend to adhere to the surface 26 of the carrier 10*b***.

Referring to FIG. 4, it should be understood that the slots 32, 34 should preferably be kept as small as is practicable. Since, as has been previously discussed, the principal purpose of the lip 14 is to prevent separating forces from acting on the leading edge of the paper, the lip should extend as far across the paper as is reasonably possible, with the spaces 32, 34 being provided to assure drainage of liquid.

Figure 7:
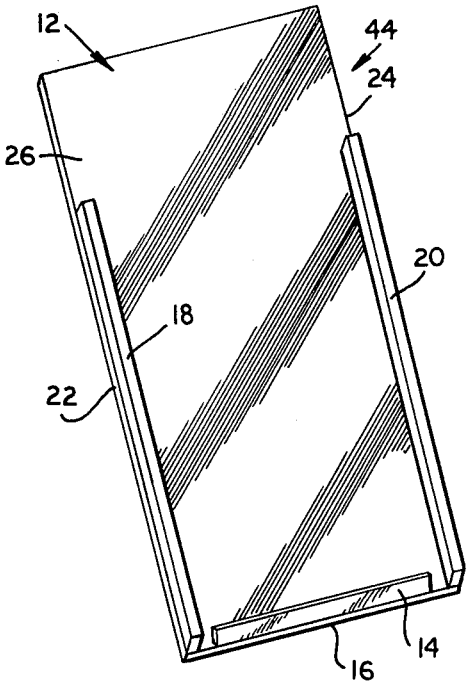
FIG. 7 is a perspective view of an alternate disclosed embodiment of the carrier of the present invention.

Referring now to FIG. 7, it will be seen that there is an alternate disclosed embodiment of the carrier 44. It will be appreciated that the carrier 44 is virtually identical to the carrier 10 except that the projections 38 are not provided on the guides 18, 20, and the peripheral edges 36 and the holes 40 are not provided on the rear surface 28 of the carrier 44. Therefore, although a plurality of carriers 44 can be stacked in a similar fashion as shown in FIG. 5, it will be understood that the carriers 44 are not fastened to one another as is possible with the carriers 10.

Figure 8:
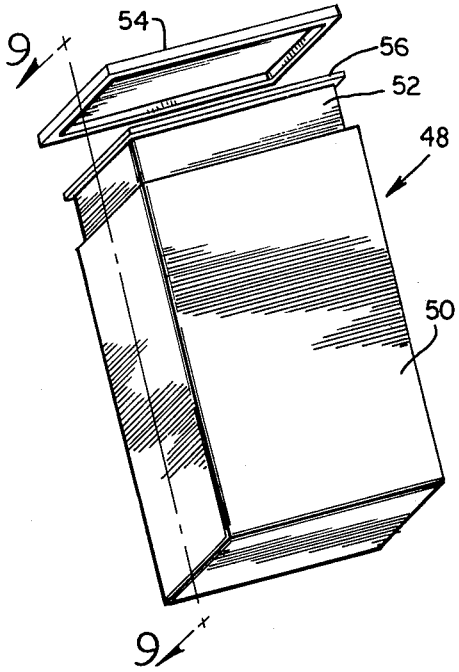
FIG. 8 is an exploded perspective view of a disclosed embodiment of the processing tank of the present invention.
Figure 10:
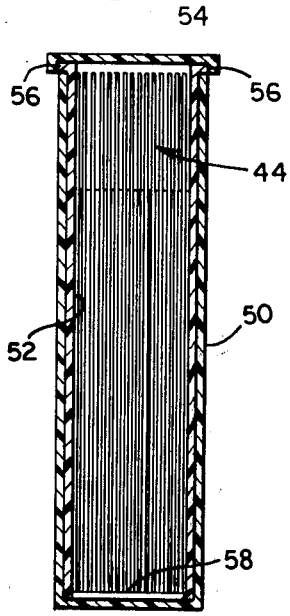
FIG. 10 is a cross-sectional view taken along the line 10—10 of the processing tank shown in FIG. 9.
Figure 9:
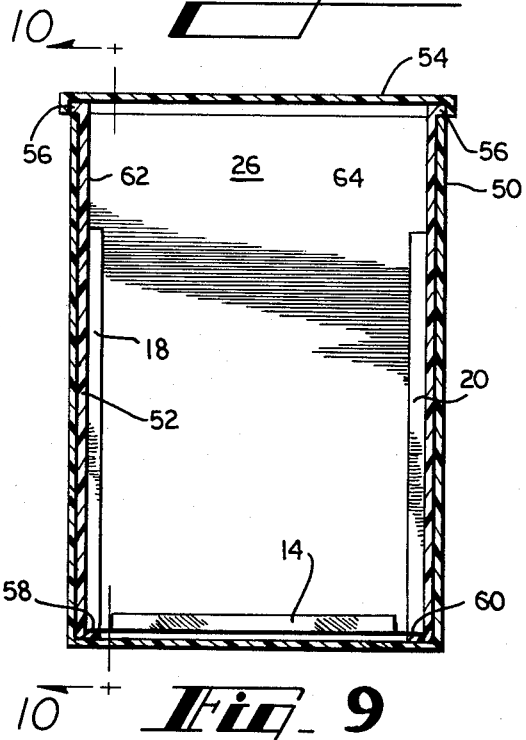
FIG. 9 is a non-exploded cross-sectional view taken along the line 9—9 of the processing tank shown in FIG. 8.

With particular reference to FIGS. 8–10, it will be seen that there is a processing tank 48 for accomodating the carriers of the present invention. Although it is contemplated that either of the carriers 10, 44 can be used with the processing tank 48, it is preferably that the carrier 44 be used.

The processing tank 48 includes an outer tank 50 suitable for holding a quantity of processing fluid, such as photographic developer, an inner sleeve 52 sized and shaped to be received in the outer tank 50 and a lid 54 for covering the top of the sleeve 52. Additionally, it will be appreciated by those skilled in the art that the sleeve 52 is also sized and shaped to receive a plurality of carriers 44 therein. A flange 56 is provided on the upper portion of the sleeve 52. When the sleeve 52 is inserted into the outer tank 50 (FIGS. 9 and 10), the flange 56 extends outwardly over the side walls of the outer tank and suspends the sleeve in the outer tank. The flange 56 also serves as a handle for the sleeve 52 so that the sleeve can be easily inserted into and removed from the outer tank 50.

The lower end of the sleeve 52 is open to permit liquid to flow into the inside of the sleeve when the sleeve is lowered into the outer tank 50. Therefore, in order to prevent the carriers 44 from falling through the lower end of the sleeve 52, flanges 58, 60 are provided on the interior side walls 62, 64 of the sleeve. The flanges 58, 60 provide a ledge upon which the lower edge 16 of the carrier 44 rests.

The operation of the carrier 44 and the processing tank 48 will now be considered. The sleeve 52 is initially removed from the outer tank 50. A processing liquid is poured into the outer tank 50. If the temperature of the processing liquid is important, as is the case particularly with color processing liquids, the outer tank 50 can be immersed into a controlled temperature bath so that heat from the bath will maintain the temperature of the liquid in the outer tank 50. It is also contemplated that a thermostatically controlled immersible heating element (not shown) can be provided in the outer tank 50 to maintain a desired temperature for the processing liquid therein.

A piece of photographic paper, which has been exposed in a photographic enlarger, is placed in the carrier 44 as previously described. Optionally, a piece of unexposed photographic paper can be placed in the carrier 44 and the carrier can be used as an easel for exposing the paper in a photographic enlarger.

After the photographic paper has been exposed and placed in the carrier 44, the carrier is placed in the sleeve 52 so that the lower edge 16 of the carrier rests on the interior flanges 58, 60 of the sleeve. The lid 54, which preferably provides a light-tight seal with the sleeve 52, is then placed on top of the sleeve to protect the photographic paper from further exposure to light while in the sleeve.

The above-described procedure can be repeated with another piece of photographic paper and another carrier. The additional carrier is then slid into the sleeve 52 on top of any carriers already in the sleeve with the back surface 28 of the additional carrier resting on the guides 18, 20 of the adjacent carrier. It is contemplated that the sleeve 52 is sized so that it can accomodate a plurality of carriers 44 (FIG. 9), such as five, ten or fifteen, so that a plurality of pieces of photographic paper can be processed simultaneously.

After the sleeve 52 has been loaded with a desired number of carriers 44 having exposed photographic paper therein, the sleeve is lowered into the outer tank 50 and into the processing liquid contained therein. As the sleeve 52 is lowered into the processing liquid, the liquid flows freely into the lower end of the sleeve and into the plurality of carriers 44 as previously described. It will be appreciated that the sleeve 52 and carriers 44 will displace a volume of liquid in the outer tank 50. Therefore, it is not necessary to initially fill the tank 50 to the top. Only so much processing liquid need be added to the tank 50 to provide a liquid level sufficient to cover the photographic paper when the sleeve 52 and carriers 44 are immersed therein.

If aggitation of the paper in the processing liquid is necessary, this can be easily accomplished by lifting the sleeve 52 partially out of the outer tank 50 and then lowering the sleeve back into the tank. By so doing, a portion of the liquid drains out of the carriers 44 and sleeve 52 and then is reintroduced into the carriers, thereby providing a change of processing liquid adjacent the sensitized surface of the photographic paper.

If the photographic paper requires processing in a plurality of different processing liquids, the sleeve 52 can be quickly withdrawn from the tank 50, the processing liquid emptied from the tank, a different processing liquid added to the tank and the sleeve reinserted into the tank and different processing liquid. Optionally, a plurality of tanks 50 can be provided each containing a different processing liquid. The sleeve 52 can then be serially inserted and withdrawn from each sucessive tank 50.

After processing of the photographic paper is complete, the sleeve 52 is withdrawn from the tank 50, the lid 54 is removed from the sleeve, the carriers 44 are removed from the sleeve and the photographic paper is removed from the surface 26 of each carrier. The photographic paper is thus ready for further processing and/or drying.

It should be understood, of course, that the foregoing relates only to preferred embodiments of the present invention and that numerous modifications or alterations may be made therein without departing from the spirit and scope of the invention as set forth in the appended claims.

I claim:

1. Apparatus for simultaneous processing of a plurality of sheets of material, said apparatus comprising:

a plurality of carriers each comprising a generally rectangular plate having a face, a back and a lower edge, said face having a smooth surface for receiving said sheet, said smooth surface being sufficiently smooth that said sheet, when wetted, will adhere to said smooth surface, said back having an irregular surface which is sufficiently irregular that said sheet, when wetted, will not adhere to said irregular surface, a lip along the lower edge of said plate and extending from said smooth surface, said lip being so constructed and arranged that said sheet is urged against said lip and said lip supports said sheet on said smooth surface;

a sleeve having a lower end and a upper end, said sleeve being sized and shaped to receive said plurality of carriers through an opening defined in said upper end of said sleeve, said lower end of said sleeve supporting said lower edge of said plate;

a tank for containing a quantity of liquid, said tank being sized and shaped to receive said sleeve therein; and said lower end of said sleeve defining at least one opening, whereby said liquid in said tank is communicable with said sheet on said smooth surface when said sleeve is received in said tank.

2. Apparatus of claim 1 further comprising a lid engageable with said sleeve to provide a light-tight seal about said opening in said upper end.

3. A carrier for a sheet of material wherein said sheet is to be immersed into a liquid bath, said carrier comprising:

a generally rectangular plate having a face with a smooth surface for receiving said sheet, a back with an irregular surface and a lower edge;

a lip along the lower edge of said plate and extending from said smooth surface, said lip being so constructed and arranged that said sheet is urged against said lip and said lip supports said sheet on said smooth surface;

a pair of guides fixed to said plate and extending perpendicular to said lip, said guides being located generally at opposite edges of said plate, said guides extending further from said smooth surface than said lip;

said lip comprising a rectangular flange member having its longitudinal axis parallel to said lower edge of said plate and fixed to said smooth surface of said plate, said flange member being of such length as to define an opening at each end thereof between said flange member and each of said pair of guides; and said carrier being stackable with a plurality of like carriers, said smooth surface being sufficiently smooth that a sheet of material, when wetted, will adhere to said smooth surface, said irregular surface being sufficiently irregular that said sheet, when wetted, will not adhere to said irregular surface, and said lip is so sized that, when a second carrier is placed on said guides of said carrier, an elongate opening is defined between said lip and said second carrier.

4. A carrier for a sheet of material wherein said sheet is to be immersed into a liquid bath, said carrier comprising:

a generally rectangular plate having a face, a back and a lower edge;

said face having a smooth surface for receiving said sheet, said smooth surface being sufficiently smooth that said sheet, when wetted, will adhere to said smooth surface;

said back having an irregular surface which is sufficiently irregular that said sheet, when wetted, will not adhere to said irregular surface;

a lip along the lower edge of said plate and extending from said smooth surface, said lip being so constructed and arranged that said sheet is urged against said lip and said lip supports said sheet on said smooth surface; and a pair of guides fixed to said plate and extending perpendicular to said lip, said guides being located generally at opposite edges of said plate and said guides being engagable with said irregular surface of another of said carriers such that a plurality of said carriers are stackable.

5. The carrier of claim 4 further including means for selectably attaching said carrier to another of said carriers.

6. A carrier for a sheet of material wherein said sheet is to be immersed into a liquid bath, said carrier comprising:

a generally rectangular plate having a face, a back and a lower edge;

said face having a smooth surface for receiving said sheet, said smooth surface being sufficiently smooth that said sheet, when wetted, will adhere to said smooth surface;

said back having an irregular surface which is sufficiently irregular that said sheet, when wetted, will not adhere to said irregular surface;

a lip along the lower edge of said plate and extending from said smooth surface, said lip being so constructed and arranged that said sheet is urged against said lip and said lip supports said sheet on said smooth surface; and a pair of guides fixed to said plate and extending perpendicular to said lip, said guides being located generally at opposite edges of said plate, whereby said carrier is stackable with a plurality of like carriers.

7. The carrier of claim 4 or 6, wherein said guides extend further from said smooth surface than said lip.

8. The carrier of claim 4 or 6, wherein said lip comprising a rectilinear flange member having its longitudinal axis parallel to said lower edge of said plate and fixed to said smooth surface of said plate, said flange member being of such length as to define an opening at each end thereof between said flange member and each of said pair of guides.

* * * * *